United States Patent [19]

Kogane et al.

[11] Patent Number: 4,540,324

[45] Date of Patent: Sep. 10, 1985

[54] DEVICE FOR DETECTING WHETHER OR NOT ONE END OF A BELT-SHAPED SHEET IS LOCKED

[75] Inventors: Mikio Kogane; Seiichi Yamazaki, both of Kanagawa, Japan

[73] Assignee: Fuji Photo Film Co., Ltd., Kanagawa, Japan

[21] Appl. No.: 467,549

[22] Filed: Feb. 17, 1983

[30] Foreign Application Priority Data

Feb. 18, 1982 [JP] Japan ..... 57-21833[U]

[51] Int. Cl.[3] ..... B65H 7/02

[52] U.S. Cl. ..... 414/20; 271/258; 271/265; 226/11; 226/92

[58] Field of Search ..... 414/19, 20; 271/258, 271/259, 265, 277; 226/11, 92

[56] References Cited

U.S. PATENT DOCUMENTS 2,966,355 12/1960 Calhoun ..... 271/258

3,073,592 1/1963 Golding ..... 271/258

*Primary Examiner*—Richard A. Schacher

*Attorney, Agent, or Firm*—Sughrue, Mion, Zinn, Macpeak, and Seas

[57] ABSTRACT

A device for detecting whether or not one end of a belt-shaped sheet is locked having a depressing bar for depressing one end of a belt-shaped sheet perpendicular to the surface of an end thereof when the end is at a locking position where to be locked by an end locking member. A detector is operated when the depressing bar is moved a predetermined distance to produce a signal representative of whether the end of the belt-shaped sheet is satisfactorily locked. The depressing bar is operated in response to a signal representing when the end of the belt-shaped sheet comes to the locking position.

9 Claims, 4 Drawing Figures

DEVICE FOR DETECTING WHETHER OR NOT ONE END OF A BELT-SHAPED SHEET IS LOCKED

BACKGROUND OF THE INVENTION

This invention relates to a device for detecting whether or not the end of a belt-shaped sheet is locked by a locking member.

The term "belt-shaped sheet" as herein used is intended to mean flexible, belt-shaped articles such as elongated papers, films or tapes. In handling such a belt-shaped sheet, i.e., in order to or convey it, its end is locked to a winding member or a conveying member. For instance, a photographic film processing device is known in the art, in which the end of a belt-shaped print paper which has been subjected to exposure is locked by a print paper conveying guide member, namely, a guide clip. The guide clip is passed through picture processing solutions such as developing and fixing solutions so that the belt-shaped print paper is suitably processed.

One example of such a prior art device will be described with reference to FIG. 1 which has been referred to in the specification of Japanese Utility Model Application No. 56-47147 filed by the applicant herein.

FIG. 1 is a perspective view showing a print paper guide clip 1 locking a belt-shaped print paper 10, which is being conveyed for processing by chain conveyor means 4. In the print paper guide clip 1, a rigid bar member 2 and a locking member 3 of elastic material, such as resin, form one unit. Both ends of the bar member 2 engage grooves 5 in the pair of chains 4 which oppose each other. Furthermore, locking pawls 6, upwardly-bent-members 7, downwardly-bent-members 8 and a central locking member 9 extend from the locking member 3 in a direction opposite to the direction of conveyance. These members engage the sheet to be conveyed.

As shown in FIG. 2, the end of the belt-shaped print paper is inserted between the upwardly-bent-members 7 and the downwardly-bent-members 8 through guide plates 12 and 13 until the locking pawls 6 engage through-holes 11 formed in the end of the print paper 10. Hence, the belt-shaped print paper 10 is locked by the print paper guide clip 1 by the pawls 6 and the through-holes 11.

In the above-described technique of locking the belt-shaped print paper 10 with the print paper guide clip 1, sometimes the locking pawls 6 do not engage the through-holes 11 formed in the end of the belt-shaped print paper 10 because of the curl of the belt-shaped print paper 10 itself, the bend of the bar member 2, or alignment of the guide plates 12 and 13 and the print paper guide clip 1. If this occurs, the belt-shaped print paper 10 is not delivered to the following process and a loss of production thru-put occurs. The belt-shaped print paper 10 may also be caught and damaged during conveyance. Accordingly, there is a requirement for detecting whether or not the end of the belt-shaped print paper 10 is positively locked by the print paper guide clip 1.

SUMMARY OF INVENTION

An object of this invention is to overcome the above-described deficiencies in the prior art.

More particularly, an object of the invention is to provide for the detection of whether or not one end of a belt-shaped sheet is locked. In accordance with the invention, a depressing bar is provided for depressing one end of a belt-shaped sheet perpendicular to the surface of the end of the belt-shaped sheet when the end is at a position to be locked by an end locking member. A detector is operated when the depressing bar is moved over a predetermined distance to produce a signal representative of the locking state the end of the sheet, that is, whether it is unsatisfactorily engaged with the locking member.

This invention will be described with respect to the drawing and the description of the preferred embodiment that follows.

DESCRIPTION OF THE PREFERRED EMBODIMENT

This invention will be described with reference to the print paper guide clip described relative to FIGS. 1 and 2.

Figure 3:
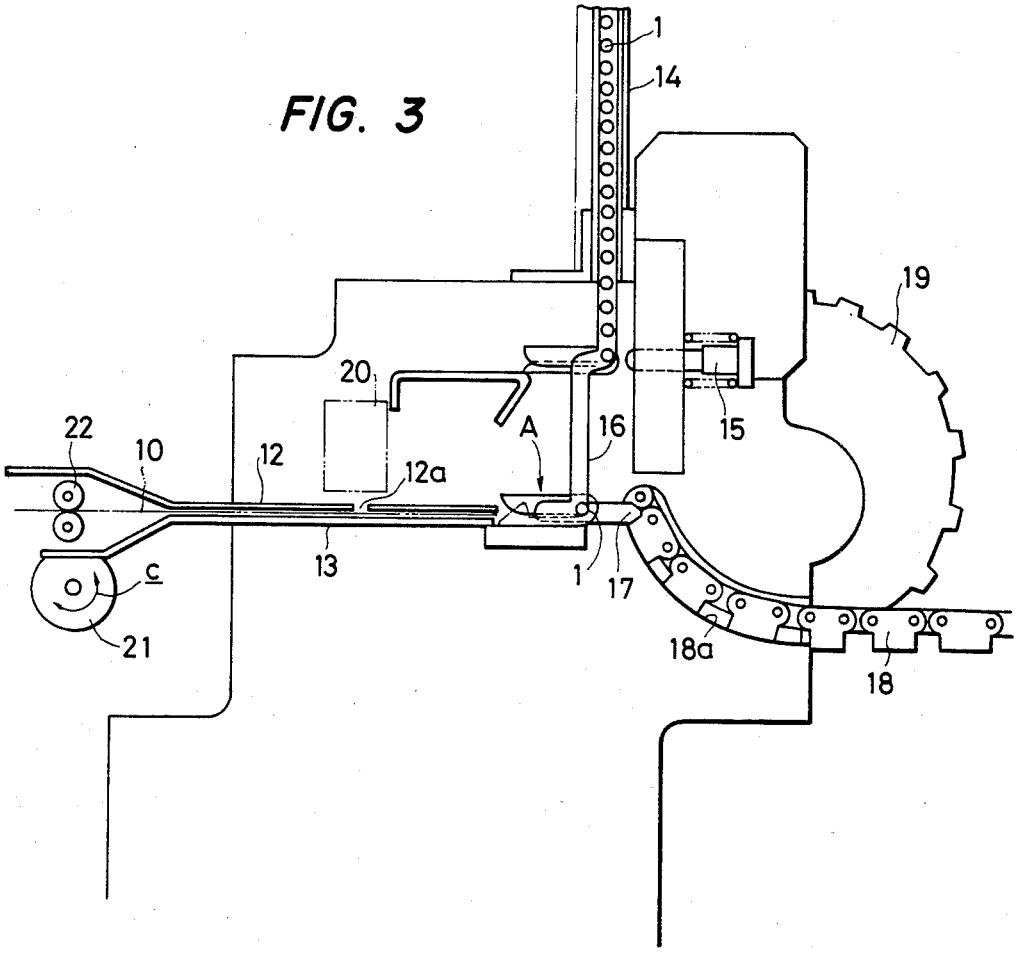
FIG. 3 is a side view showing a unit for causing a guide clip to lock one end of a belt-shaped sheet according to one embodiment of the invention.
Figure 4:
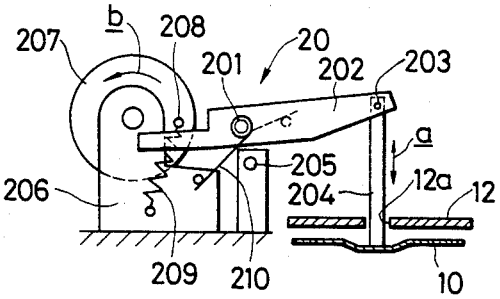
FIG. 4 is a front view showing a device for detecting whether or not one end of a belt-shaped sheet has been positively locked.

FIG. 3 shows a side view of a unit for causing the guide clip to lock the end of the print paper. FIG. 4 is a front view, partly as a sectional view, showing a device for detecting the locking of the end of a print paper, which is an essential component of the unit in FIG. 3.

Figure 1:
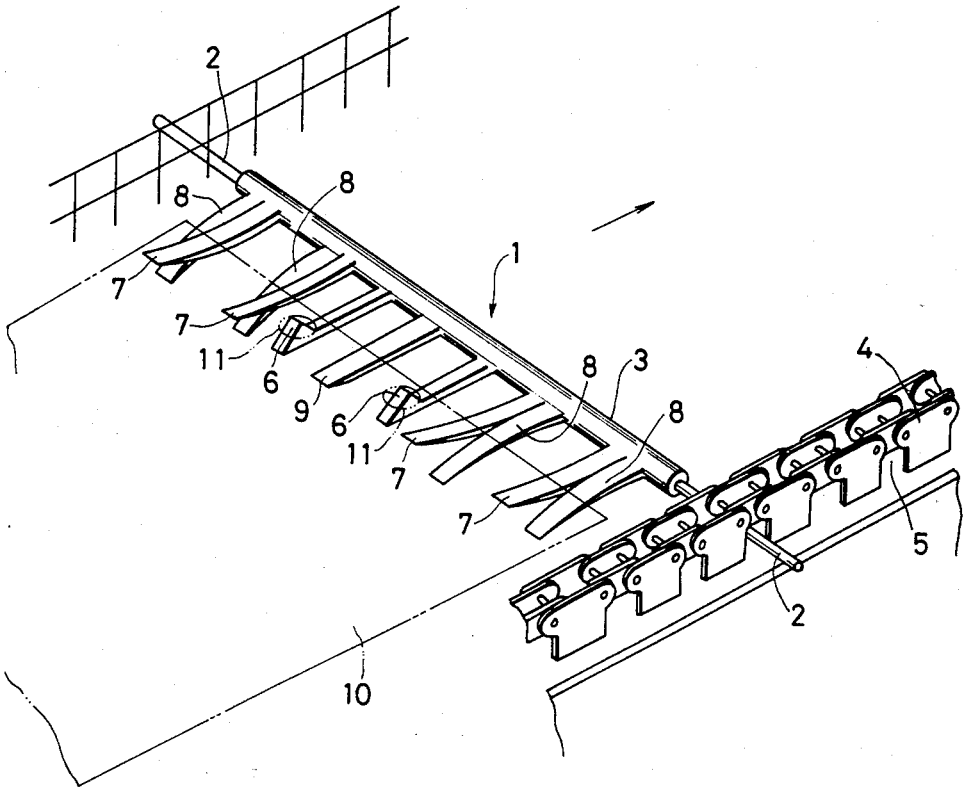
FIG. 1 PRIOR ART
FIG. 1 is a perspective view showing a prior art technique for locking one end of a belt-shaped sheet.
Figure 2:
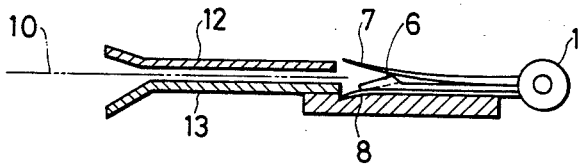
FIG. 2 PRIOR ART
FIG. 2 is a side view showing the essential components in FIG. 1.

In FIGS. 3 and 4, reference numerals 1 through 13 designate components which are similar to those designated by the same reference numerals, respectively in FIGS. 1–2. Further in FIGS. 3 and 4, reference numeral 14 designates a hopper which accommodates a plurality of guide clips 1; 15, a plunger for dropping the guide clips 1 along vertical grooves 16 one after another beginning with the lowest one; 17, horizontal grooves for leading the guide clip 1, which has locked the end of the print paper 10, to grooves 18*a* of chains 18; 19, sprockets for driving the chains 18; and 20, the device for detecting the locking of the end of a print paper (hereinafter referred to merely as "a detecting device", when applicable).

In the detecting device 20, as shown in FIG. 4, one end of an arm 202 which rocks about a pin 201 is coupled through a pin 203 to a detecting bar 204. Bar 204 is moved vertically as indicated by the arrow a thereby to depress the print paper 10. When the stroke of the detecting bar 204 exceeds a predetermined value, the arm 202 covers an optical sensor 205, to detect that the end of the print paper is unsatisfactorily locked.

A rotary type solenoid 207 is secured to a frame 206 and is turned in the direction of the arrow b. A pin 208 embedded in the rotary surface of the solenoid 207 is turned counterclockwise against the elastic force of a spring 209, while the arm 202, being urged clockwise by a coil spring 210 wound on the pin 201, it turned clockwise.

The upper guide plate 12 has a hole 12*a* through which the detecting bar 204 is moved vertically. On the other hand, as shown in FIG. 3, the lower guide plate 13 is coupled to a rotary type solenoid 21 at one end, so that it is moved to and from the upper guide plate 12 as the solenoid 12 turns in the direction of the arrow c.

The operation of this detecting device will be described. A print paper 10 which has been subjected to exposure as required is delivered near to the entrance of the upper and lower guide plates 12 and 13. In this case, the lower guide plate 13 is close to the upper guide plate 12 as shown in FIG. 3, and the guide clip 1 is set at a predetermined locking position (as indicated at A). The print paper 10 is advanced through the upper and lower guide plates 12 and 13, and normally the end 10 of the print paper 10 is locked by the guide clip 1 at the locking position A. When a detector, such as an optical sensor (not shown), detects the arrival of the end of the print paper 10 to the locking position, the solenoid 21 is excited to turn clockwise, so that the lower guide plate 13 is moved away from the upper guide plate 12. Thereafter (after the lapse of a certain period of time has been detected by a timer circuit for instance), the solenoid 207 is excited, so that the detecting lever 204 is moved down to push the print paper as described above. In the case where the end of the print paper 10 is positively locked by the guide clip 1, even when the lower guide plate 13 is moved away from the lower guide plate 13 as described above the end portion of the print paper 10 has a certain amount of tension (T) between the guide clip 1, both ends of which are supported by guide grooves (provided at the intersections of the vertical grooves 16 and the horizontal grooves 17) and guide members (such as guide rollers 22) provided along the conveying path. Accordingly, in this case, the print paper 10 will not be slackened downwardly against the force of depression ($T_1$) of the detecting bar 204 as long as $T>T_1$ is maintained. In other words, when the print paper 10 is positively locked by the guide clip 1, the stroke of the detecting bar 204, i.e., the locking angle of the arm 202 is within a predetermined range at all times. Accordingly, the arm 202 will not cover the optical sensor 205.

When the end of the print paper 10 has been positively locked by the guide clip 1, this occurrence is detected as described above and the guide clip 1 is sent along the horizontal grooves 17 into the grooves 18*a* of the chains 18. The printing paper delivered to the following process such as developing as the sprockets 19 turns.

When, on the other hand, the end of the paper 10 is not locked by the guide clip 1, the tension T is zero or substantially zero (i.e., $T<T_1$). Accordingly, as the detecting bar moves downwardly, the arm 202 is also moved downwardly to close the optical sensor 205, so that a signal representing the fact that the end of a print paper is unsatisfactorily locked is generated.

By utilization of the signal, the generation of an alarm signal to stop the device can occur. Also, the return of the end of the print paper 10 to the entrance of the upper and lower guide plates 12 and 13 can be effectuated to repeat the locking process, or a cutter may be employed to cut the end of the print paper 10 and send the new end of the print paper to the locking position A. Such devices may be added to the system of this invention as required by the user.

The detecting device, constructed as described above, can detect in advance whether or not the end of the print paper 10 has been positively locked by the guide clip 1. Accordingly, the overall work efficiency of the system is improved, the loss in production is decreased whereby the precentage of yield is increased, and the frequency of mechanical failure is decreased.

While one preferred embodiment of the invention has been illustrated and described in detail, it is understood that the invention is not limited thereto or thereby. That is, various changes and modifications may be made therein without departing from the true spirit of the invention.

For instance, instead of the detector for detecting the unsatisfactory locking of the end of the print paper, sensor technique may be employed.

For instance, in addition to the above-described optical sensor, a conventional detecting switch, such as a limit switch or contactless switch, may be employed as the detecting means for providing the signal representing that the end of the print paper is unsatisfactorily locked. Alternatively, the sensor output can be employed to determine that engagement is proper, that is, by having optical continuity maintained after the depressing bar is actuated. Thus, the sensor will produce a positive output indicating that proper engagement and locking have taken place. The bar for depressing the end of the belt-shaped sheet may be operated according to a dropping system instead of the spring system.

The invention is applicable not only to the case of conveying a belt-shaped sheet, but also to the case where a belt-shaped sheet is wound on a winding core, reel or spool with the end of the belt-shaped sheet locked by the end locking member. In this case also, the above-described significant effects can be obtained.

We claim:

1. A device for detecting whether or not an end of a sheet is locked for conveyance comprising:

means for engaging and locking said end of said sheet to convey it from one position to another under tension;

reciprocating means moving orthogonal to said sheet for depressing one end of said sheet in a direction generally perpendicular the surface of said sheet when said sheet is moved into a locking position; and detector means responsive to movement of said reciprocating means for depressing to produce an output signal representative of whether said sheet is engaged and locked to said engaging means.

2. The device of claim 1 further comprising means to actuate said reciprocating means for depressing in response to a signal representing whether the end of said sheet is in an engaging position with said engaging means.

3. The device of claim 2, wherein said means to actuate comprises a solenoid rotatable and biased for movement in one direction.

4. The device of claim 1, wherein said means for depressing comprises a vertically disposed bar, an arm having a linking member to couple it to said reciprocating bar to allow vertical motion of said bar and, bias means to move said arm to depress said bar, under a force of depression $T_1$ such that if the tension of said sheet T is $T>T_1$, said sensor will produce an output indicative of locking of said sheet.

5. The device of claim 4, wherein said sensor is positioned to be responsive to movement of said bar such that is $T<T_1$ then said sensor will produce an output indicative that said sheet is not locked to said engaging means.

6. The device of claim 4, further comprising a solenoid disposed to position said arm in a first position when it is not actuated so that said bar does not depress said sheet, and when said solenoid is actuated said bias means moves said arm to a second position for depressing said sheet with said bar.

7. The device of claim 6, further comprising spring means to bias said solenoid for positioning said arm in said first position.

8. The device of claim 1, wherein said means for engaging and locking said end of the sheet comprises a rigid bar extending across the end of said sheet, at least one pair of extending upwardly and downwardly bent fingers protruding from said rigid bar to orient an end edge of said sheet and, a locking pawl extending outward from said rigid bar to engage a hole at the end of said sheet.

9. The device of claim 8, further comprising a central locking member disposed at the center of said rigid bar and extending outwardly and a locking pawl on each side of said central locking member.

* * * * *